US012527445B1

(12) United States Patent
Brookshire

(10) Patent No.: US 12,527,445 B1
(45) Date of Patent: Jan. 20, 2026

(54) ADJUSTABLE BACKREST FOR A TOILET SEAT

(71) Applicant: Christine L Brookshire, Highlands Ranch, CO (US)

(72) Inventor: Christine L Brookshire, Highlands Ranch, CO (US)

( * ) Notice: Subject to any disclaimer, the term of this patent is extended or adjusted under 35 U.S.C. 154(b) by 69 days.

(21) Appl. No.: 18/442,678

(22) Filed: Feb. 15, 2024

Related U.S. Application Data

(60) Provisional application No. 63/451,755, filed on Mar. 13, 2023.

(51) Int. Cl.
*A47K 13/28* (2006.01)

(52) U.S. Cl.
CPC ..... *A47K 13/28* (2013.01)

(58) Field of Classification Search
CPC ..... A47K 13/28
USPC ..... 4/237, 234, 98, 217; 297/188.01, 250.1
See application file for complete search history.

(56) References Cited

U.S. PATENT DOCUMENTS 2,582,321 A * 1/1952 Farrell ..... A47K 17/02 4/234
3,392,411 A * 7/1968 Hansen ..... A47K 13/005 4/239
5,539,937 A * 7/1996 Barefoot ..... A47K 13/307 4/213
6,158,060 A * 12/2000 Wheeler ..... A47K 13/24 4/664
2008/0086804 A1* 4/2008 Goh Aow ..... A47K 13/06 4/300
2010/0251472 A1* 10/2010 Culwell ..... A47K 17/022 4/237
2011/0239364 A1* 10/2011 Goldstein ..... A61G 7/1059 4/237
2014/0013496 A1* 1/2014 Blair ..... A47K 13/06 4/239
2015/0196178 A1* 7/2015 Schottenstein ..... A47K 17/02 4/234
2018/0132679 A1* 5/2018 Chmiel ..... A47K 13/10
2019/0374077 A1* 12/2019 Blair ..... A47K 17/02
2020/0093337 A1* 3/2020 Schwab ..... A61G 5/1062
2020/0093665 A1* 3/2020 Schwab ..... A61G 5/122
2020/0095757 A1* 3/2020 Schwab ..... E03D 11/125

FOREIGN PATENT DOCUMENTS

CN 104783721 A * 7/2015 ..... A47K 11/04
CN 111904320 A * 11/2020 ..... A47K 13/28
CN 112401727 A * 2/2021 ..... A47K 13/24
CN 115177173 A * 10/2022 ..... A47K 13/305
CN 116649821 A * 8/2023 ..... A47K 11/04
DE 102007028678 B3 * 10/2008 ..... A47K 13/12
GB 2418209 A * 3/2006 ..... A47K 13/12
KR 20040028457 A * 4/2004 ..... A47K 13/12
(Continued)

*Primary Examiner* — Lori L Baker
(74) *Attorney, Agent, or Firm* — Kenneth L. Tolar

(57) ABSTRACT

An adjustable backrest for a conventional toilet includes a panel having a plurality of spaced, internally threaded sleeves embedded within a rear surface. Threadedly received within each sleeve is a mounting bolt with a disc at a distal end. The discs slide within retainers on a mounting sheet adhesively attached to the lid. Accordingly, the panel provides a backrest adjacent the rear end of a toilet-seat opening to accommodate smaller users.

8 Claims, 1 Drawing Sheet

(56) References Cited

FOREIGN PATENT DOCUMENTS

| | | | | | |
|---|---|---|---|---|---|
| KR | 102372559 | B1 | * | 3/2022 | ..... A47K 13/14 |
| KR | 102372562 | B1 | * | 3/2022 | ..... A47C 7/402 |
| KR | 20220150591 | A | * | 11/2022 | ..... A47K 17/024 |
| WO | WO-2018085939 | A1 | * | 5/2018 | ..... E03D 11/125 |
| WO | WO-2020068885 | A1 | * | 4/2020 | ..... A47K 13/10 |

* cited by examiner

ADJUSTABLE BACKREST FOR A TOILET SEAT

CROSS REFERENCE TO RELATED APPLICATIONS

This application claims priority of provisional application No. 63/451,755 filed on Mar. 13, 2023, the specification of which is incorporated herein by reference.

BACKGROUND OF THE INVENTION

The present disclosure relates to an adjustable toilet seat backrest for accommodating users with certain physical limitations.

DESCRIPTION OF THE PRIOR ART

Because conventional toilet seats are universally sized with large, elongated openings, they are not always suitable for children or smaller adults. Though potty chairs assist certain children with using a conventional toilet seat, they are unsuitable for larger children or smaller adults. Furthermore, the elderly, the infirm, or those with certain physical ailments cannot comfortably use a standard toilet seat without assistance. As a result, those with such physical limitations often sit on the rear portion of the seat to use the lid as a backrest. However, sitting on the rear portion of the seat increases the likelihood of depositing waste products on the seat, which is extremely unsanitary and requires frequent cleaning.

Accordingly, there is currently a need for a toilet seat that accommodates users with certain physical limitations. The present invention disclosure addresses this need by providing an adjustable backrest for a toilet seat that effectively reduces the distance between the lid and the toilet seat opening to properly position smaller users on the toilet seat.

SUMMARY OF THE INVENTION

An adjustable backrest for a conventional toilet includes a panel having a plurality of spaced, internally threaded sleeves embedded within a rear surface. Threadedly received within each sleeve is a mounting bolt with a disc at a distal end. The discs slide within retainers on a mounting sheet adhesively attached to the lid. Accordingly, the panel provides a backrest near the rear portion of the toilet-seat opening to accommodate smaller users.

It is therefore an object of the present disclosure to provide a toilet-seat backrest that allows users with certain physical limitations to use a standard sized toilet seat.

It is therefore another object of the present disclosure to provide a toilet-seat backrest that is adjustably mounted on a toilet.

It is therefore yet another object of the present disclosure to provide a toilet-seat backrest that is easily securable to and removable from a toilet-seat lid.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 2:
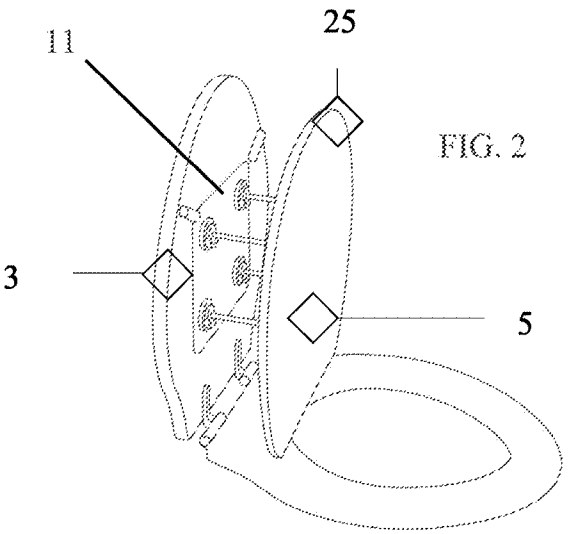
FIG. 2 is a side, perspective view of the backrest and toilet seat.
Figure 4:
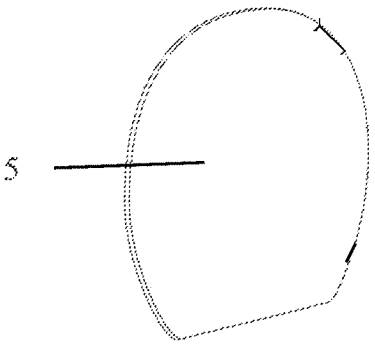
FIG. 4 is an isolated, front view of the backrest panel.
Figure 1:
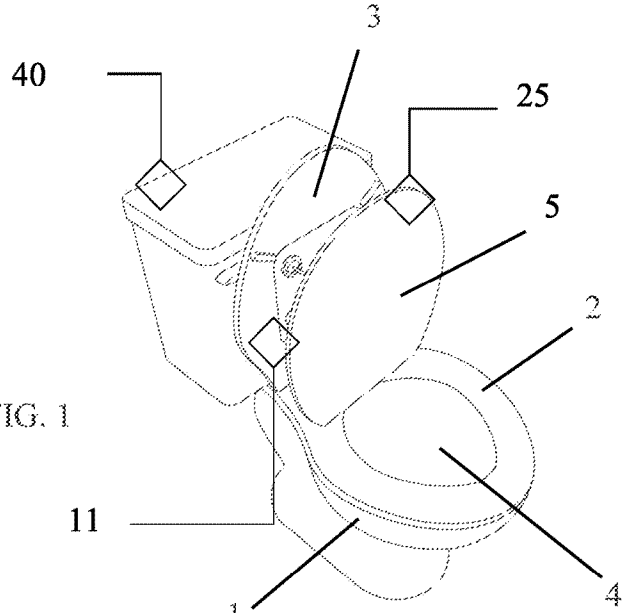
FIG. 1 is a perspective view of the backrest according to the present disclosure mounted on a toilet.
Figure 3:
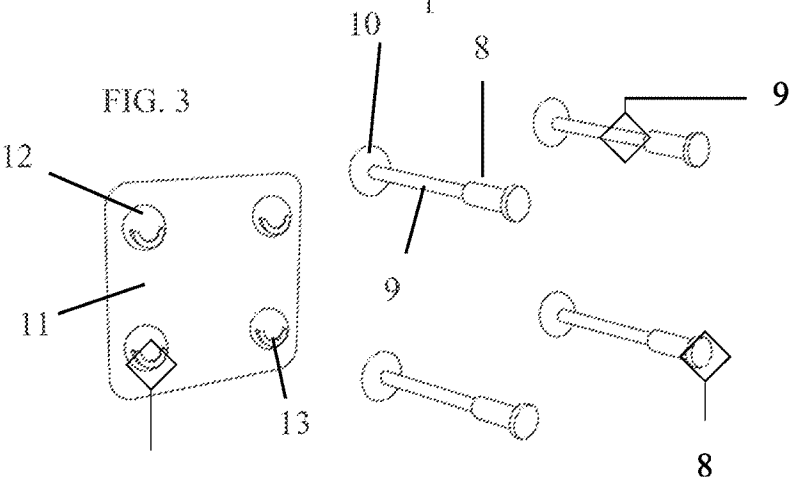
FIG. 3 is an isolated, perspective view of the attachment sheet and mounting bolts.

An adjustable backrest 25 for uprightly supporting users with certain physical limitations on a conventional toilet includes a tank 40 and a bowl 1 for receiving waste materials. The bowl includes an upper surface with an opening 4 and a toilet seat 2 and a lid 3 positioned thereon that are each pivotal between a raised, vertical position and a lowered, horizontal position. The backrest 25 includes a panel 5 having substantially the same size and geometrical outline as the lid 3 and includes a front surface, a rear surface, and at least one peripheral edge. A plurality of spaced, internally threaded sleeves 8 are embedded within or otherwise attached to the rear surface of the panel. Threadedly received within each sleeve is a mounting bolt 9 with an attachment disc 10 at a distal end.

The device further includes a mounting sheet 11 adhesively secured to the lower surface of the toilet lid. The sheet includes a plurality of retainers 12 with semicircular ledges 13 for firmly receiving the discs to removably secure the panel to the lid. The distance between the panel and lid can be selectively varied by rotating the bolts prior to attachment according to user preference, size, or other parameters.

Accordingly, a user with certain physical limitations raises the lid to a vertical position and attaches the panel to the mounting sheet to effectively reduce the distance between the lid and the toilet-seat opening. The positioning of the panel relative to the opening can be easily adjusted by rotating the mounting bolts prior to attachment to the lid.

The above-described device is not limited to the exact details of construction and enumeration of parts provided herein. Furthermore, the size, shape, and materials of construction of the various components can be varied without departing from the spirit of the present invention.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The invention claimed is:

1. A toilet with an adjustable backrest comprises:

a bowl having an opening;

a toilet seat and a lid pivotal onto and away from said opening;

a panel having a front surface, a rear surface, and at least one peripheral edge, said panel attached to but spaced from said lid for effectively reducing a distance between said lid and said opening;

a mounting sheet attached to a lower surface of said lid, said mounting sheet having at least one retainer thereon;

at least one mounting bolt extending from the rear surface of said panel, said mounting bolt having an attachment disk at a distal end for removably seating within said retainer.

2. The toilet according to claim 1 wherein said at least one mounting bolt is received within a threaded sleeve attached to the rear surface of said panel to allow a distance between said panel and said lid to be selectively varied.

3. The toilet according to claim 1 wherein said retainer includes semicircular ledge for firmly receiving the disc to removably secure the panel to the lid.

4. The toilet according to claim 1 wherein said panel has a substantially similar size and geometrical outline as said lid.

5. A toilet with an adjustable backrest comprises:

a bowl having an opening;

a toilet seat and a lid pivotal onto and away from said opening;

a panel having a front surface, a rear surface, and at least one peripheral edge, said panel attached to but spaced from said lid for effectively reducing a distance between said lid and said opening, said panel having a substantially similar size and geometrical outline as said lid.

6. The toilet according to claim 5 further comprising:

a mounting sheet attached to a lower surface of said lid, said mounting sheet having at least one retainer thereon;

at least one mounting bolt extending from the rear surface of said panel, said mounting bolt having an attachment disk at a distal end for removably seating within said retainer.

7. The toilet according to claim 6 wherein said at least one mounting bolt is received within a threaded sleeve attached to the rear surface of said panel to allow a distance between said panel and said lid to be selectively varied.

8. The toilet according to claim 6 wherein said retainer includes semicircular ledge for firmly receiving the disc to removably secure the panel to the lid.

* * * * *